US005562435A

United States Patent [19]

Cho et al.

[11] Patent Number: 5,562,435

[45] Date of Patent: Oct. 8, 1996

[54] STRUCTURE FOR PREVENTING AXIAL LEAKAGE IN A SCROLL COMPRESSOR

[75] Inventors: Kyung H. Cho; Jong H. Park, both of Gwangmyung, Rep. of Korea

[73] Assignee: LG Electronics, Inc., Seoul, Rep. of Korea

[21] Appl. No.: 425,446

[22] Filed: Apr. 20, 1995

[30] Foreign Application Priority Data

Apr. 20, 1994 [KR] Rep. of Korea ..... 1994-8348
May 17, 1994 [KR] Rep. of Korea ..... 1994-10851

[51] Int. Cl.[6] ..... F01C 1/04

[52] U.S. Cl. ..... 418/55.5; 418/57; 418/104

[58] Field of Search ..... 418/55.4, 55.5, 418/57, 104

[56] References Cited

U.S. PATENT DOCUMENTS 3,874,827 4/1975 Young ..... 418/55.5
4,767,293 8/1988 Caillat et al. ..... 418/55.5
4,877,382 10/1989 Caillat et al. ..... 418/55.5

FOREIGN PATENT DOCUMENTS 271680 10/1989 Japan ..... 418/55.5

*Primary Examiner*—Charles Freay

[57] ABSTRACT

A structure for preventing axial leakage in a scroll compressor includes a fixed scroll, a closer mounted on the fixed scroll, a discharge chamber formed on the closer, a discharge port formed at the center of the fixed scroll, and a variable back pressure formed between the closer and the fixed scroll. The variable back pressure chamber is formed penetrating to the discharge chamber by a polytetrafluoroethylene(PTFE) or a piston. By the polytetrafluoroethylene(PTFE) having uniform expansion coefficient and the piston, the variable back pressure chamber is closed in case of high discharge pressure and opened in case of low pressure. A downward sealing force is acting on small area of a upper surface of the fixed scroll in case of high discharge pressure and broad area in case of low pressure.

7 Claims, 7 Drawing Sheets

STRUCTURE FOR PREVENTING AXIAL LEAKAGE IN A SCROLL COMPRESSOR

BACKGROUND OF THE INVENTION

This invention relates to a scroll compressor, and more particularly to a structure with variable action area on which a discharge back pressure is acting to prevent an axial leakage between the tips of scroll wraps and the bottom of the opposing scroll and to prevent abrasion of the scroll wrap in the scroll compressor.

In general, the conventional scroll compressor comprises a fixed scroll 10, an orbiting scroll 11, an Oldham coupling 12 as a device for preventing rotation, a main frame 13, and a crankshaft 14, as shown in FIG. 1. The fixed scroll 10 is fixed to the main frame 13, so as to be movable axially, by a leaf spring 15 (see FIG. 5) and a bolt. As the orbiting scroll 11 is connected to the crankshaft 14, the orbiting scroll 11 is orbited by a motor which comprises a rotor 16 and a stator 17. However, rotation of the orbiting scroll 11 is otherwise prevented by Oldham coupling 12.

A suction port 18 is formed under the orbiting scroll 11, and a discharge port 19 is formed at the center of the fixed scroll 10. A closer 20 (FIG. 2), a back pressure chamber 30 (FIG. 5), and a back pressure hole 31 (FIG. 5) are formed in an upper portion of the fixed scroll 10, and a discharge chamber 32 is formed as illustrated.

The refrigerant gas drawn into the scroll compressor through the suction port 18 is sucked in the fixed and orbiting scroll by the orbiting motion of the orbiting scroll 11 and, at the same time, is trapped in lunette-shaped pockets. By the continuous orbiting motion of the orbiting scroll 11, the refrigerant gas within the trapped volume is continuously moved towards the center of the wraps while being reduced in volume until it is discharged to the discharge port 19. Generally, the crankshaft 14 is rotated 2 to 3 times during one cycle from suction to discharge.

During the process of compression in the scroll compressor, there is some leakage of the refrigerant gas from the high pressure inner pocket to the low pressure outer pocket. Axial leakage takes place in a gap between the tips of the scroll wraps and the bottom of the opposing scroll, and radial leakage occurs in a gap between the opposing scroll wraps.

In order to prevent axial leakage the conventional scroll compressor, as shown in FIG. 2, has the fixed scroll 10 fixed to main frame 13 (FIG. 1) so as to be axially movable. The discharge pressure acts on the fixed scroll 10 from the upper side, so that any gap between the tips of the scroll wraps and the bottom of the opposing scroll becomes tighter so as to minimize the axial leakage.

FIG. 3 is a pressure distribution diagram of the conventional scroll compressor. A downward sealing force may be written as $$\Sigma F=F_d+F_{s1}-F_{S2}-F_c \quad (1),$$

where $F_d$ is a sealing force by the discharge pressure, $F_{s1}$ is a sealing force by the low pressure of the refrigerant gas filled in the shell of the compressor, $F_{s2}$ is a low pressure, and $F_c$ is a repulsive force caused by a compressive force. And, F=P×A, where P is a pressure and A is a area.

As shown in the above equation, since the intensity of the force acting on the fixed scroll 10 is determined by that of the discharge pressure, the scroll compressor should be designed to get the best sealing effect according to any driving condition, that is, the standard condition.

FIG. 4 indicates the totality of conditions (#1~#18) within which the scroll compressor may be operated. In the above-mentioned scroll compressor, however, the difference of the sealing forces is too large over the range of respective operating conditions, and the sealing force may be negative at some operating conditions. A negative sealing force means that the fixed scroll 10 is pushed upwardly, which indicates that the desired compression is not obtained because of axial leakage. On the other hand, when the sealing force is large, the gap between the tips of the scroll wraps and the bottom of the opposing scroll becomes too small and, because of this, the motor may be overloaded. Further, if the sealing force is larger than a certain limit, the tips of the scroll wraps become worn.

FIG. 5 indicates another type of conventional scroll compressor.

In this type of conventional scroll compressor, a back pressure chamber 30 with a uniform cross section is formed on the upper surface of the fixed scroll 10 and a part of the refrigerant gas is sent to the back pressure chamber 30, of which the pressure is uniformly maintained, through a back pressure hole 31 for preventing axial leakage and abrasion of the tips caused by too much sealing force. Therefore, a uniform sealing force acts on the upper surface of the fixed scroll 10 so that the axial gap is minimized, thus minimizing axial leakage.

In the case where back pressure is used so as to minimize axial leakage as shown in FIG. 5, however, a part of the refrigerant gas during compression flows into the back pressure chamber. Thus a loss of efficiency occurs in the P-V diagram as illustrated in FIG. 6. In other words, there is a problem in that the hole between the discharge chamber and the back pressure chamber causes low efficiency of the scroll compressor.

FIG. 7 indicates the pressure distribution diagram of this conventional scroll compressor. Therefore, the downward sealing force may be expressed as $$\Sigma F=F_{d+Fb}+F_{s1}-F_{s2}-F_c \quad (2),$$

where $F_d$ is the sealing force by the discharge pressure, $F_b$ is a sealing force by the back pressure, $F_{s1}$ is the sealing force by the low pressure of the refrigerant gas filled in the shell of the compressor, $F_{s2}$ is the low pressure, and $F_c$ is the repulsive force caused by the compressive force.

Consequently, conventional scroll compressors which use the discharge pressure for sealing have a problem of a drop in efficiency caused by leakage of the refrigerant gas. And, they also experience faster wear caused by abrasion of the tips of the scroll wraps due to too large a downward sealing force which may at times occur.

SUMMARY OF THE INVENTION

It is an object of the present invention to provide a structure for preventing axial leakage between tips of the scroll wraps and the bottom of the opposing scroll in a scroll compressor.

It is another object of the present invention to provide a structure for preventing abrasion of the scroll wraps caused by an excessive downward sealing force on the upper surface of the fixed scroll when the discharge pressure is high.

According to the present invention, the structure for preventing axial leakage in the scroll compressor comprises a fixed scroll which is fixed to a main frame by a leaf spring and bolt so as to be axially movable, an orbiting scroll orbited by the crankshaft, a suction port formed under the orbiting scroll, a discharge port formed at the center of the fixed scroll, a closer mounted on the fixed scroll, a variable back pressure chamber which is formed between the fixed scroll and the closer for varying the downward sealing force acting on the upper surface of the fixed scroll, and a means for opening and closing the variable back pressure chamber.

DETAILED DESCRIPTION OF THE INVENTION

This invention will now be described in detail with reference to the accompanying figures.

Figure 1:
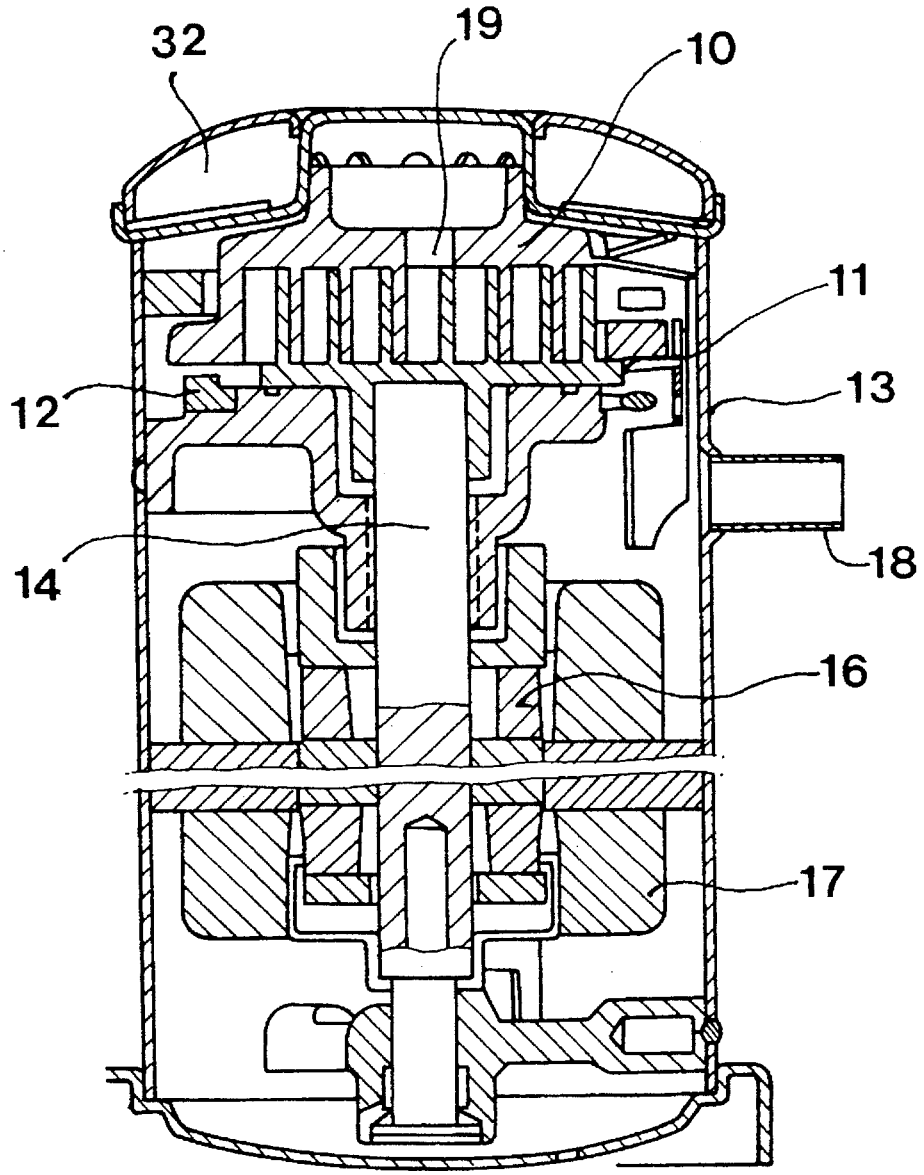
FIG.1 PRIOR ART
FIG. 1 is a vertical sectional view of a conventional scroll compressor.
Figure 2:
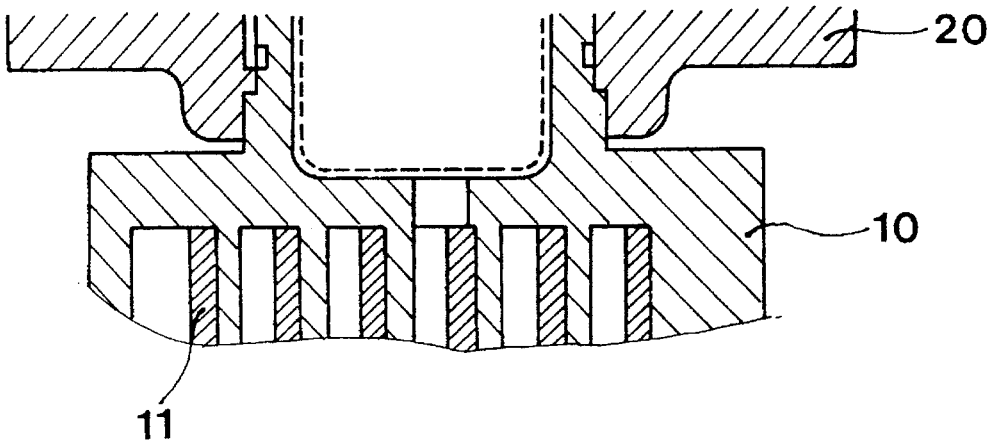
FIG. 2 PRIOR ART
FIG. 2 is a sectional view of a conventional structure which prevents axial leakage by using a high discharge pressure to seal a scroll compressor.
Figure 3:
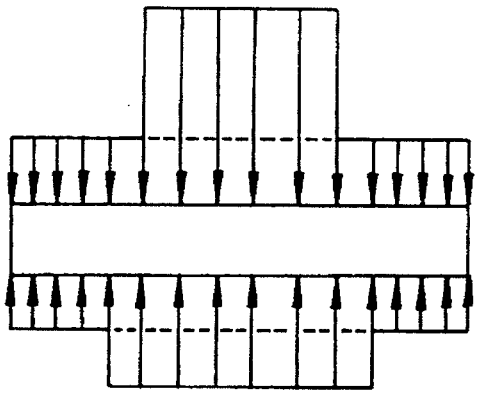
FIG. 3 PRIOR ART
FIG. 3 is a pressure distribution diagram of a conventional scroll compressor according to FIG. 2.
Figure 4:
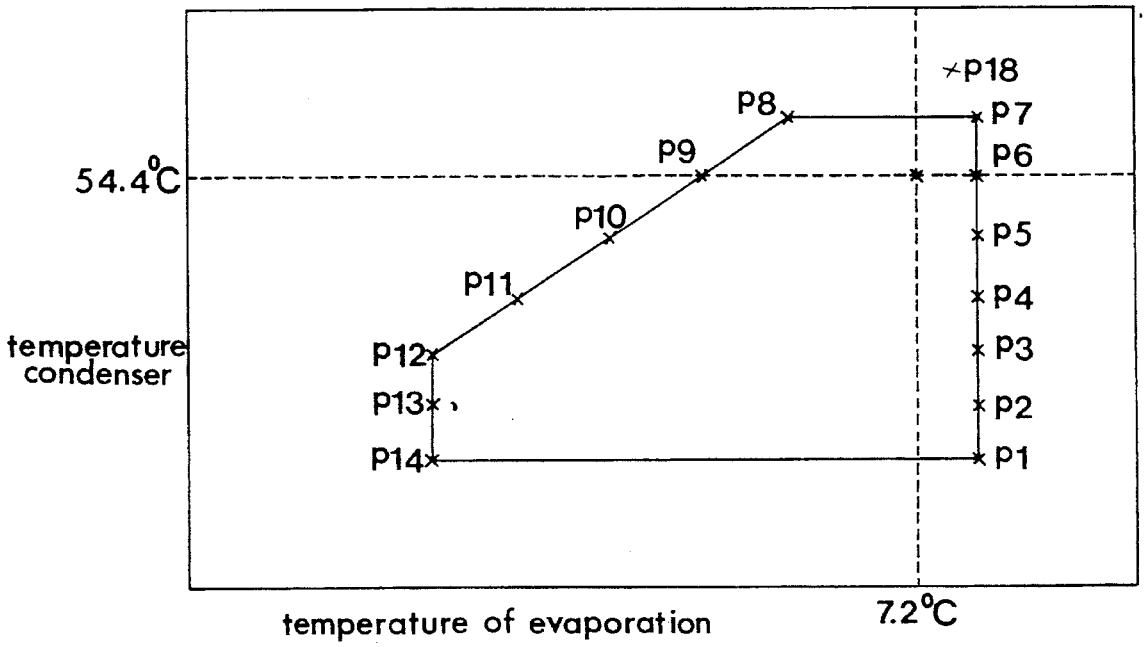
FIG. 4 PRIOR ART
FIG. 4 is a diagram of operating conditions of the scroll compressor of FIG. 1 when used for cooling.
Figure 5:
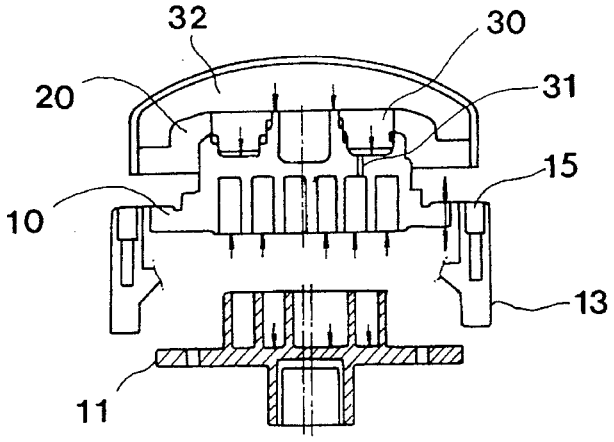
FIG.5 PRIOR ART
FIG. 5 is a sectional view of a conventional structure for preventing axial leakage by using back pressure in a scroll compressor.
Figure 6:
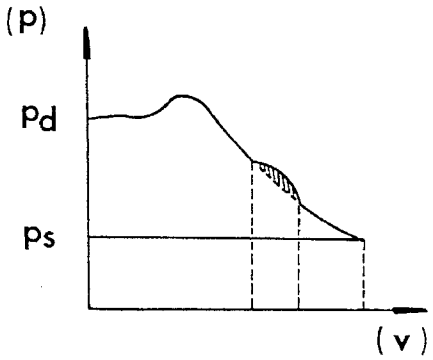
FIG. 6 PRIOR ART
FIG. 6 is a P-V diagram of the conventional scroll compressor shown in FIG. 5.
Figure 7:
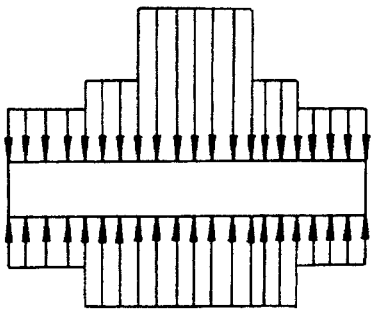
FIG. 7 PRIOR ART
FIG. 7 is a pressure distribution diagram of the conventional scroll compressor shown in FIG. 5.
Figure 8:
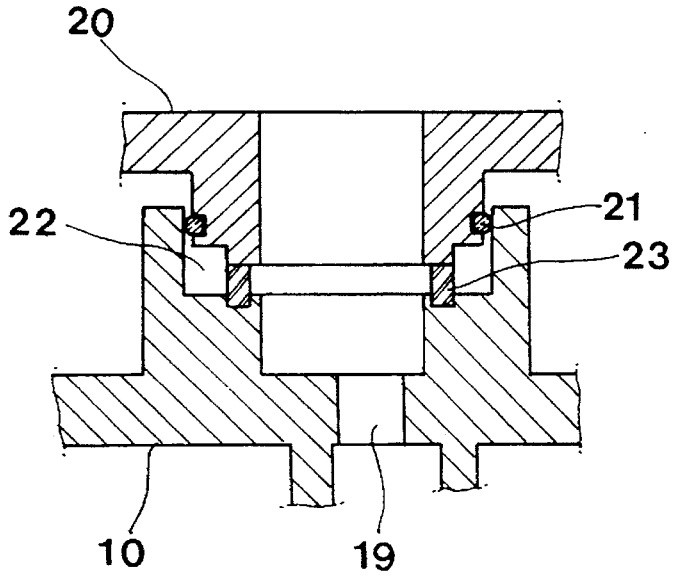
FIG. 8 is a sectional view of a structure for preventing axial leakage in a scroll compressor according to a first preferred embodiment of the present invention.

As illustrated in FIG. 8, a first embodiment of this invention comprises a fixed scroll 10, a discharge port 19 formed at the center of the fixed scroll 10, a closer 20 mounted on the upper side of the fixed scroll 10, a seal packing for sealing a clearance between the closer 20 and the fixed scroll 10, a variable back pressure chamber 22 formed between a cutout portion of the inner side of the fixed scroll 10 and the under side of the closer 20, and a variable sealing member 23 made of a metal or engineering plastic material which is attached to the end of the closer 20 for opening and closing the variable back pressure chamber. A preferred engineering plastic material for use as the variable sealing member 23 is polytetra-fluoroethylene(PTFE), which has the structure $CF_2{=}CF_2$.

In this invention, as in the conventional art, the orbiting scroll is eccentrically orbited about the center of the crankshaft and the refrigerant gas is sucked into an outer end of the orbiting scroll. The sucked refrigerant gas is trapped in lunette-shaped pockets which are moved to the center of the orbiting scroll as the volume of the pockets gradually decreases, so that the refrigerant gas is compressed. When the pockets of compressed gas reach the center of the orbiting scroll, the discharge port 19, formed at the center of the fixed scroll 10, is opened and the refrigerant gas is discharged.

A first embodiment of the present invention will now be described with reference to FIGS. 8, 9(*a*) and 9(*b*).

After the refrigerant gas is discharged through the discharge port 19, as illustrated in FIG. 8, if the gas is relatively high pressured, that is, if overloaded gas is discharged into the chamber 32, it enters the discharge area, Ad1. In such case, the downward force to push the fixed scroll 10 is diminished because the variable sealing member 23 is squeezed as shown in FIG. 9(*b*), thereby closing the variable back pressure chamber 22 formed between the closer 20 and the fixed scroll 10.

Figure 9A:
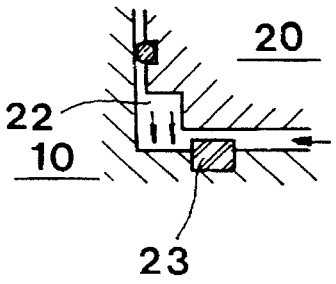
FIGS. 9(*a*) and 9(*b*) are enlarged, detailed views of the variable sealing member 28 of FIG. 8 under a standard condition of pressure and under an overloaded condition, respectively.
Figure 9B:
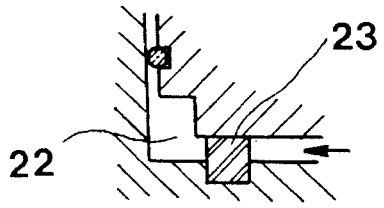

On the contrary, FIG. 9(*a*) indicates the flow of the refrigerant gas in the standard condition, that is, where the discharged refrigerant gas is under relatively low pressure. If low pressure refrigerant gas is discharged, the variable back pressure chamber opens to the discharge port 19, as shown in FIG. 9(*a*). Therefore, the refrigerant gas acts on a larger area of the upper surface of the fixed scroll 10 and the downward sealing force acting thereon is thereby increased.

Therefore, the downward sealing pressure acts on a small area of the upper surface of the fixed scroll for the high pressured refrigerant gas and on a larger area of the same surface for the low pressured gas.

Consequently, the area on which the refrigerant gas is acting is variable following the pressure of the refrigerant gas because of the variable sealing member, so that a more stable downward sealing force acts on the upper surface of the fixed scroll to prevent, for low output pressures, axial leakage between the tips of the scroll wraps and the bottom of the opposing scroll and, for high output pressures, unnecessary abrasion of the scroll wrap.

The expansion coefficient $\alpha$ of the variable sealing member, PTFE, is approximately $10.0\times10^{-5}$ mm/mm·° C. In case where the length of the PTFE is 30 mm for refrigerant gas of 21 atm and 122° C. in the standard condition, the variation is 30 μ for 25 atm and 134° C. in the overloaded condition.

Figure 10:
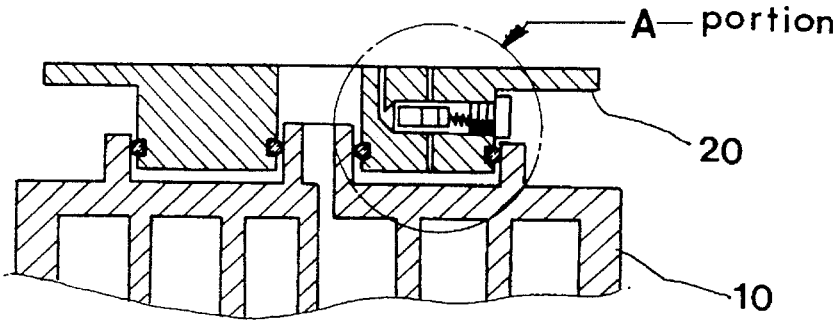
FIG. 10 is a sectional view of a structure for preventing axial leakage in a scroll compressor according to a second preferred embodiment of the present invention.
Figure 11:
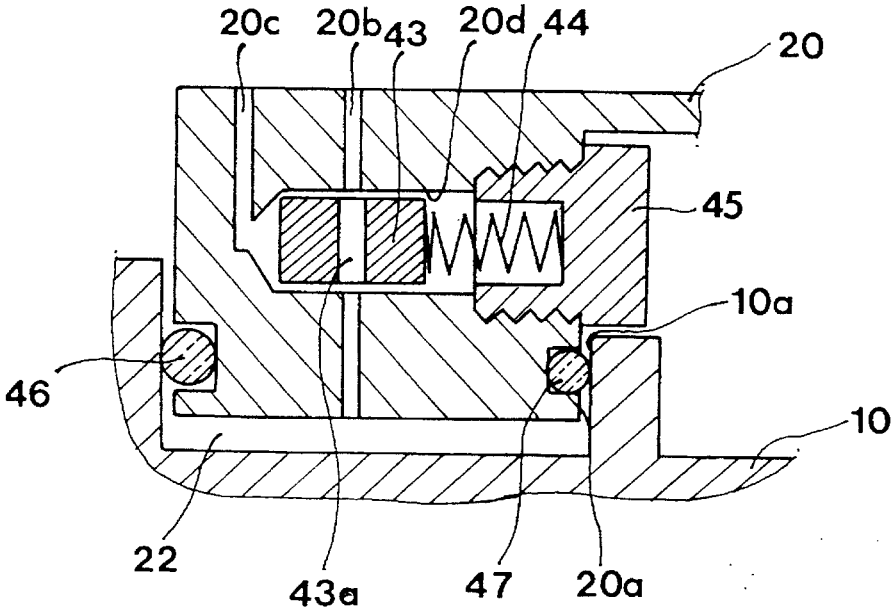
FIG. 11 is an enlarged sectional view of a portion of FIG. 10.
Figure 12:
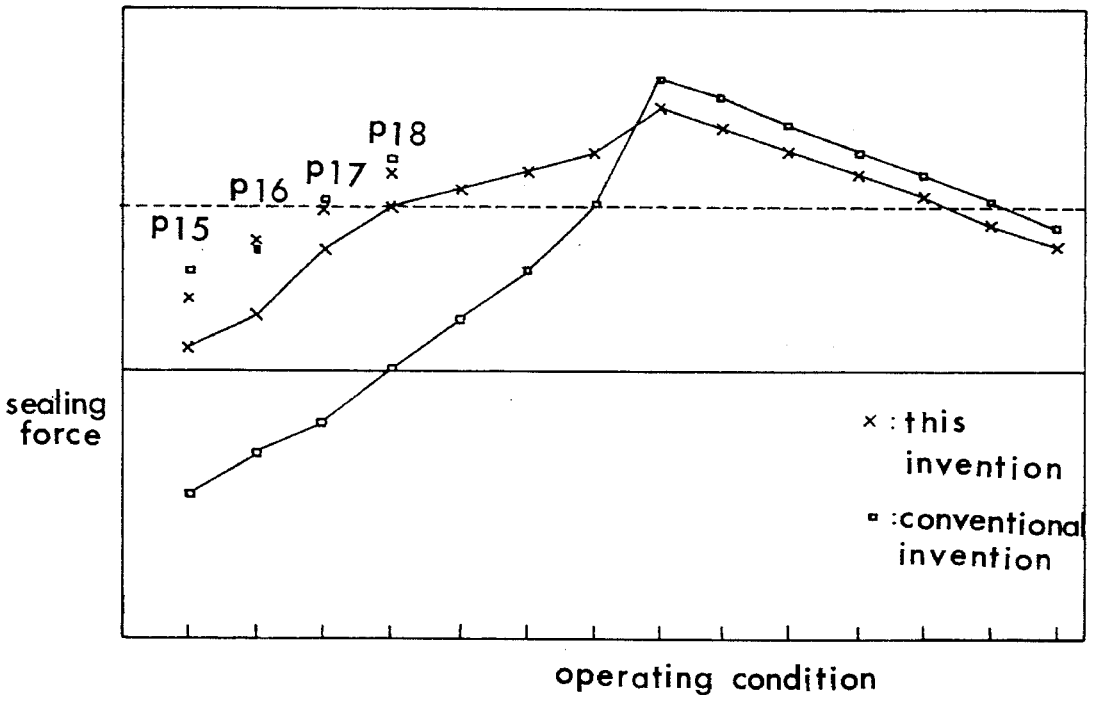
FIG. 12 is a view comparing the sealing forces versus the conventional art according to respective operating conditions of the second preferred embodiment of the invention.

FIGS. 10 and 11 illustrate the second embodiment of this invention. It will be described in detail with reference to the accompanying figures.

A projection part 20*a* (FIG. 11) of the closer 20 is fitted to the boss 10*a* of the fixed scroll 10 to form the variable back pressure chamber 22. Reference numbers 46 and 47 show the variable sealing member in different states of expansion when sealing the projection part 20*a* of the closer 20 and the boss 10*a* of the fixed scroll 10. A first penetration hole 20*b*, which penetrates to the discharge chamber, and an insertion groove are formed in the closer 20. A piston 43 is inserted in the insertion groove. In the peripheral surface of the piston, a penetration hole 43*a* is formed to open and close the first penetration hole 20*b* by the left and right movement of the piston 43. A second penetration hole 20*c*, being formed in the closer 20, is positioned to the left side of the piston 43, so that the discharge pressure is acting on the left side of the piston 43. In the right end of the piston 43, the elastic member 44 fixed by a cap 45 is inserted, so that it acts on the right side of the piston 43.

In the case where the discharge pressure is low, the first penetration hole 20*b* is opened so that the downward sealing force acts on the broad area of upper surface of the fixed scroll 10. If the discharge pressure of the refrigerant gas exceeds the limit, the discharge pressure transmitted through the second penetration hole 20*c* is larger than the elastic force of the elastic member 44, so that the refrigerant gas pushes the piston 43 to the right side so as to close the first penetration hole 20*b*. Accordingly, the downward sealing pressure acts on a smaller area of upper surface of the fixed scroll 10.

The pressure of the variable back pressure chamber is kept approximately constant by the above mentioned operation. The variation of the sealing force at various driving conditions, as shown in FIG. 13, is decreased and the sealing force is maintained at a positive value in any driving condition, so that the axial leakage of the refrigerant gas is prevented.

As mentioned above, the structure for preventing axial leakage in the scroll compressor of this invention varies the downward sealing force on the upper surface of the fixed scroll according to discharge pressure to effectively prevent axial leakage for low discharge pressures. And, the downward sealing force acts on a smaller area of the upper surface of the fixed scroll for high discharge pressures so that the abrasion of the scroll wrap by an excessive sealing force is also prevented.

While the preferred form of this invention has been described, it is to be understood that modifications will be apparent to those skilled in the art without departing from the spirit of the invention.

The scope of the invention, therefore, is to be determined solely by the following claims.

What is claimed is:

1. A structure for preventing axial leakage in a scroll compressor comprising:

a fixed scroll;

a closer mounted on said fixed scroll;

a discharge chamber formed on said closer;

a discharge port which is formed at the center of said fixed scroll for discharging a refrigerant gas into said discharge chamber;

a variable back pressure chamber, being formed between said closer and said fixed scroll, penetrating to said discharge port according to the pressure of said refrigerant gas; and a means for opening/closing said variable back pressure chamber according to the pressure of said refrigerant gas.

2. A structure for preventing axial leakage in the scroll compressor of claim 1 wherein said means for opening/closing is a variable sealing member which is made of a metal or a engineering plastic material.

3. A structure for preventing axial leakage in the scroll compressor of claim 2, wherein said variable sealing member is an engineering plastic material made of polytetrafluoroethylene (PTFE) which has an expansion coefficient $\alpha$ of approximately $10.0\times10^{-5}$ mm/mm° C.

4. A structure for preventing axial leakage in the scroll compressor of claim 1, said means for opening/closing further comprising:

a first hole through said closer;

a piston, with a hole therein, positioned in an insertion groove formed in said closer, said insertion groove crossing said first penetration hole;

a cap for covering said groove; and means for driving said piston in a right or left direction to open or close said first hole.

5. A structure for preventing axial leakage in the scroll compressor of claim 4, said means for driving said piston further comprising:

a second hole, in said closer and positioned to apply a discharge pressure to a first end of said piston; and an elastic member which applies a bias force to said piston over at least a portion of the range of movement of said piston.

6. A structure for preventing axial leakage in a scroll compressor comprising:

a fixed scroll;

a closer mounted on said fixed scroll;

a discharge chamber formed on said closer;

a discharge port for discharging a refrigerant gas into said discharge chamber;

a variable back pressure chamber, formed between said closer and said fixed scroll; and means for opening/closing said variable back pressure chamber so as to be selectively in gaseous communication with said discharge chamber according to the pressure of said refrigerant gas in said discharge chamber.

7. A structure for preventing axial leaking in the scroll compressor of claim 6, said means for opening/closing being a variable sealing member which is made of a metal or an engineering plastic material.

* * * * *